US008095041B2

(12) United States Patent
Nanno et al.

(10) Patent No.: US 8,095,041 B2
(45) Date of Patent: Jan. 10, 2012

(54) FIXING DEVICE AND IMAGE FORMING APPARATUS

(75) Inventors: Shigeo Nanno, Kyoto (JP); Yoshikazu Yamazoe, Osaka (JP); Osamu Saito, Ibaraki (JP); Takuya Etoh, Osaka (JP); Yutaka Naitoh, Hyogo (JP)

(73) Assignee: Ricoh Company, Limited, Tokyo (JP)

( * ) Notice: Subject to any disclaimer, the term of this patent is extended or adjusted under 35 U.S.C. 154(b) by 646 days.

(21) Appl. No.: 12/205,969

(22) Filed: Sep. 8, 2008

(65) Prior Publication Data

US 2009/0074440 A1 Mar. 19, 2009

(30) Foreign Application Priority Data

Sep. 14, 2007 (JP) ..... 2007-240249

(51) Int. Cl.
*G03G 15/20* (2006.01)
*G03G 21/00* (2006.01)

(52) U.S. Cl. ..... 399/122; 399/329; 399/330

(58) Field of Classification Search ..... 399/122, 399/328, 329, 330, 331, 339
See application file for complete search history.

(56) References Cited

U.S. PATENT DOCUMENTS 5,572,307 A * 11/1996 Tomatsu et al. ..... 399/122
5,956,547 A * 9/1999 Kamei et al. ..... 399/122
6,330,419 B1 * 12/2001 Sano et al. ..... 399/322
6,580,894 B1 * 6/2003 Kobashigawa ..... 399/329
7,330,682 B2 2/2008 Shinshi
7,477,868 B2 * 1/2009 Tomatsu ..... 399/328
7,515,850 B2 * 4/2009 Hasegawa ..... 399/124
2004/0240913 A1 * 12/2004 Tomatsu ..... 399/328
2008/0056783 A1 3/2008 Yamamoto et al.

FOREIGN PATENT DOCUMENTS

JP 63056663 A * 3/1988
JP 06266261 A * 9/1994
JP 2005208545 A * 8/2005
JP 2006-48005 2/2006
JP 2006-48025 2/2006
JP 3812594 6/2006

* cited by examiner

*Primary Examiner* — David Gray
*Assistant Examiner* — Fred L Braun
(74) *Attorney, Agent, or Firm* — Oblon, Spivak, McClelland, Maier & Neustadt, L.L.P.

(57) ABSTRACT

A fixing device includes a pair of fixing members opposing each other and a pressing lever that is rotatable around a shaft. The pressing lever can be moved either to a pressing position in which one of the fixing members is pressed against the other fixing member, or to a pressure releasing position in which the one of the fixing member is separated from the other fixing member. When the pressing lever moves between the pressing position and the pressure releasing position, a first control unit located near an end of the pressing lever controls displacement of the end.

17 Claims, 10 Drawing Sheets

FIXING DEVICE AND IMAGE FORMING APPARATUS

CROSS-REFERENCE TO RELATED APPLICATIONS

The present application claims priority to and incorporates by reference the entire contents of Japanese priority document 2007-240249 filed in Japan on Sep. 14, 2007.

BACKGROUND OF THE INVENTION

1. Field of the Invention

The present invention relates to a technology for controlling a positional relation between components of a fixing device for use in an image forming apparatus.

2. Description of the Related Art

As well known in the art, in an image forming apparatus such as a printer, a copying machine, a facsimile machine, and a printing machine, a latent image formed on a latent image carrier is developed with toner into a toner image and the toner image is transferred and fixed onto a recording medium. Thus, a copy of an original is obtained.

As an example of a device used for fixing process, a device that adapts a heat roller fixing system is well known in the art. More specifically, in the heat roller fixing system, a toner image can be fixed due to fusing and penetrating of toner caused by heat and pressure applied to the toner image by a pair of opposing rollers that sandwich a conveying path of a recording paper.

The heat roller fixing system is generally provided with a fixing roller that is made into contact with toner and a pressure roller that is pressed toward the fixing roller. The rollers are configured such that the level of pressure to be applied to the pressure roller can be adjusted so that appropriate heat is provided to the toner. Further, the pressure roller may be configured to have a function for preventing fused toner on a recording paper passing through a fixing nip from sticking to the fixing roller because of its adhesive force while the recording paper is wound around the fixing roller. For example, Japanese Patent Application Laid-open No. 2006-48025 discloses a technology for so-called "self-stripping" of a recording paper from a fixing roller. Specifically, pressure is applied to the pressure roller to purposely deform the recording paper passing through the nip portion, so that the recording paper is bent back when the recording paper passes through the nip portion, by a shape restoring force due to a bending rigidity of the recording paper. Thus, the recording paper can be peeled off from the fixing roller.

The rollers are configured such that they always come into contact with each other but can be separated if necessary (for example, when a jammed paper sheet is removed).

For example, Japanese Patent No. 3812594 discloses a technology for controlling contacting and separating of rollers in a fixing device. Specifically, the fixing device includes a pressing lever that presses one of fixing members against the other fixing member, a pressure releasing lever rotatably supported on the pressing lever, a locking member of which one end is rotatably attached to the pressure releasing lever, and an elastic member that is locked to the other end of the locking member and pulls the locking member in a locking direction. With this configuration, a positional relation of the fixing members is controlled between a pressing position in which one of the fixing members is pressed against the other fixing member by the pressing lever and a pressure releasing position in which one of the fixing members is separated from the other fixing member, by moving a position of the locking member by rotating the pressure releasing lever.

The fixing roller is configured such that rotatably-connected pressing levers are disposed on each of the longitudinal ends of the pressure roller, or a pressing member, as well as the pressure roller is pressed against the fixing roller by biasing one end of each pressing lever by a pressing spring. The pressing levers are pressed against the fixing roller at high forces by the pressing spring to obtain the action of the self-stripping. This configuration may cause such problems that the pressing levers may be tilted or deformed, or one of the pressing levers may touch the pressing spring thereby reducing a pressing force of the fixing roller. Because of the problems, balance between the pressures applied on the left and the right ends of the pressing lever may be lost or the recording sheet may stick to the fixing roller, which supplies heat, by an adhesive force of the fused toner. Further, the toner image may be poorly fixed on the recording sheet or a layer configuration of the endless belt may be disturbed. As a result, meandering or deviated running of the endless belt occurs, resulting in damaging the endless belt or reducing the duration of life of the endless belt.

SUMMARY OF THE INVENTION

It is an object of the present invention to at least partially solve the problems in the conventional technology.

According to an aspect of the present invention, there is provided a fixing device that includes a fixing member including a first member and a second member that sandwich a recording medium and apply heat and pressure to fix a toner image on the recording medium; a pressing lever that is rotatable around a rotating shaft and moves either to a pressing position in which the first member is pressed toward the second member or to a releasing position in which the first member is separated from the second member; and a first control unit that is arranged near a first end of the pressing lever and controls displacement of the first end in an axial direction of the rotating shaft when the pressing lever moves between the pressing position and the releasing position.

According to another aspect of the present invention, there is provided an image forming apparatus that includes the above fixing device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below in detail with reference to the accompanying drawings.

Figure 1:
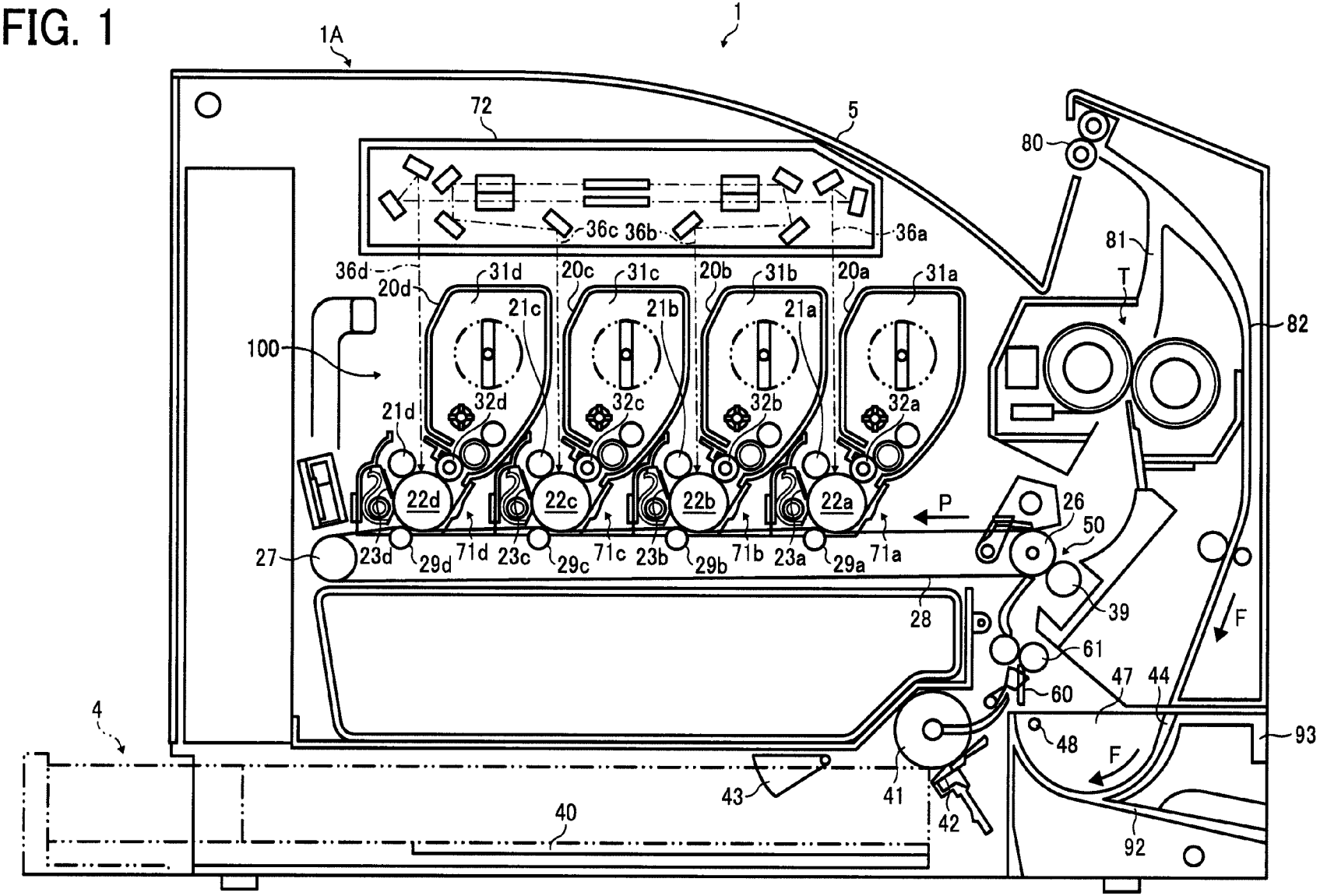
FIG. 1 is a schematic for explaining a configuration of an image forming apparatus that includes a fixing device according to an embodiment of the present invention.

FIG. 1 is a schematic of a color printer 1 as an image forming apparatus that includes a fixing device T according to an embodiment of the present invention. The color printer 1 can form a full-color image. Here, an image forming apparatus according to the present invention is not limited to a color printer described above and can be other machines such as a copying machine, a printing machine, and a facsimile machine. The color printer 1 is an electrophotographic image forming apparatus that records an image on recording media by using an electrophotographic method. The present invention is, however, not limited thereto. An image can also be recorded on recording media, for example, by using ink-jet printing.

As shown in FIG. 1, the color printer 1 includes drum-shaped photoreceptors (hereinafter, "photoreceptor drums") 22*a*, 22*b*, 22*c*, and 22*d* that are used as latent image carriers and imaging units 71*a*, 71*b*, 71*c*, and 71*d*. In each of the imaging units 71*a*, 71*b*, 71*c*, and 71*d*, a device that performs a charging process, a developing process, and a cleaning process for each of the photoreceptor drums 22*a*, 22*b*, 22*c*, and 22*d* for a corresponding color is housed in a process cartridge. In the color printer 1, a tandem method is employed in which the imaging units 71*a*, 71*b*, 71*c*, and 71*d* are disposed in parallel along the extending direction of an intermediate transfer belt 28, or an intermediate transfer unit, that is used for sequentially transferring each of color images formed by each of the imaging units 71*a*, 71*b*, 71*c*, and 71*d*.

The color printer 1 includes a housing body 1A that can accommodate an image forming unit 100. The image forming unit 100 is located generally in the middle of the direction of the height of the housing body 1A.

An optical scanning device 72 is located above the image forming unit 100. Below the image forming unit 100, a paper feeding unit 4 is located that accommodates a paper feeding cassette functioning as an accommodating unit for accommodating and holding sheet-shaped recording media such as recording paper (hereinafter, "recording paper (sheet)").

Each of the imaging units 71*a*, 71*b*, 71*c*, and 71*d* used in the image forming unit 100 corresponds to a latent image carrier, and forms corresponding image carrying units 20*a*, 20*b*, 20*c*, and 20*d*. The image carrying units 20*a*, 20*b*, 20*c*, and 20*d* respectively accommodate the photoreceptor drums 22*a*, 22*b*, 22*c*, and 22*d* that can rotate clockwise in FIG. 1; roller charging devices 21*a*, 21*b*, 21*c*, and 21*d* that are disposed on and made into contact with the respective circumferences of the corresponding photoreceptor drums; developing devices 31*a*, 31*b*, 31*c*, and 31*d* having developing rollers 32*a*, 32*b*, 32*c*, and 32*d* respectively that visualize latent images formed on the corresponding photoreceptor drums 22*a*, 22*b*, 22*c*, and 22*d*; and image cleaning devices 23*a*, 23*b*, 23*c*, and 23*d* that scrapes off residual toner by contacting the corresponding photoreceptor drums 22*a*, 22*b*, 22*c*, and 22*d*.

In the image carrying units 20*a*, 20*b*, 20*c*, and 20*d*, the photoreceptor drums 22*a*, 22*b*, 22*c*, and 22*d* that are initialized by being electrically charged uniformly by the roller charging devices 21*a*, 21*b*, 21*c*, and 21*d* at a high voltage are selectively exposed and scanned in darkness according to a given image data by using laser beams 36*a*, 36*b*, 36*c*, and 36*d* output from the optical scanning device 72. As a result, a latent image is formed as low potential parts in which electric potential is reduced because of the exposure and high potential parts in which electric potential charged by the initialization remains still. The developing devices 31*a*, 31*b*, 31*c*, and 31*d* transfer toner to the low potential parts (alternatively to the high potential parts) of the latent image and visualize a toner image. Thus, a toner image is formed (developed).

The image carrying units 20*a*, 20*b*, 20*c*, and 20*d* are configured so that housings of each image carrying units can accommodate the corresponding developing devices 31*a*, 31*b*, 31*c*, and 31*d*. The photoreceptor drums 22*a*, 22*b*, 22*c*, and 22*d* rotate clockwise and move the toner image in the circumferential direction. Thus, the toner image can be conveyed to a primary transfer position.

Forming of a latent image as well as forming of a toner image by developing are performed in each of the image carrying units 20*a*, 20*b*, 20*c*, and 20*d* by setting timings sequentially. As will be described later, primary transfer of images is sequentially performed for each different color such as cyan, magenta, yellow, and black to the intermediate transfer belt 28 of which an extending surface opposing the image carrying units 20*a*, 20*b*, 20*c*, and 20*d* moves in the direction of an arrow P in FIG. 1 are. As a result, a full color super imposed image is carried thereon.

More specifically, processing timing is set such that when a toner image transferred from the imaging unit 71*a* onto the intermediate transfer belt 28 is conveyed to a next primary transfer unit, that is, a contacting portion between the intermediate transfer belt 28 and the photoreceptor drum 22*a* (at the contacting portion, a primary transfer roller 29*a* is disposed on the back side of the intermediate transfer belt 28), the photoreceptor drum 22*b* of the imaging unit 71*b* next to the imaging unit 71*a* performs transfer processing in the same way as in the imaging unit 71*a*. Then, the developing device 31*b* visualizes the latent image on the photoreceptor drum 22*b*, thereby turning (developing) the latent image into a toner image. The toner image is then conveyed by the rotation of the photoreceptor drum 22*b* and transferred onto the intermediate transfer belt 28 so that the toner image presently formed is superimposed on the toner image previously formed on the intermediate transfer belt 28. The similar operations are performed sequentially by the imaging units 71*c* and 71*d*.

Negative bias voltage in which alternating current and direct current are superimposed from a bias supply (not shown) is applied to metal cores of the developing rollers 32*a*, 32*b*, 32*c*, and 32*d* due to electrostatic phenomena. Negative direct current bias voltage from another bias supply is applied to each of the roller charging devices 21*a*, 21*b*, 21*c*, and 21*d*, and thus the photoreceptor drums are electrically charged. To perform primary transfer, the primary transfer rollers 29*a*, 29*b*, 29*c*, and 29*d* are disposed on the back side of the intermediate transfer belt 28 contacting the photoreceptor drums 22*a*, 22*b*, 22*c*, and 22*d*.

The difference between the image carrying units 20*a*, 20*b*, 20*c*, and 20*d* is in developers used in a developing device. As developers, various toners with different colors such as cyan, yellow, magenta, and black are used. In the present embodiment, the image carrying units 20*a*, 20*b*, 20*c*, and 20*d* are disposed along the intermediate transfer belt 28 that extends in the lateral direction. The photoreceptor drums 22*a*, 22*b*, 22*c*, and 22*d* are also disposed in a row, contacting the intermediate transfer belt 28.

The intermediate transfer belt 28, which is used as a primary transfer member, has an extending surface in a lateral direction of the color printer 1. The photoreceptor drums 22*a*, 22*b*, 22*c*, and 22*d* are disposed along the extending surface of the intermediate transfer belt 28.

The intermediate transfer belt 28 is configured so that one end is supported by a driving roller 26 that is located on the side of the photoreceptor drum 22*a* and protruded from the image forming unit 100, while the other end is supported by a follower roller 27 that is located on the side of the photoreceptor drum 22*d*. The intermediate transfer belt 28 rotates counter-clockwise. A secondary transfer roller 39 is disposed opposing the driving roller 26, and a nip portion between the secondary transfer roller 39 and the driving roller 26 constitutes a secondary transfer unit 50.

The primary transfer rollers 29*a*, 29*b*, 29*c*, and 29*d* apply pressure on the upper surface of the intermediate transfer belt 28 so that the upper surface of the intermediate transfer belt 28 touches the photoreceptor drums 22*a*, 22*b*, 22*c*, and 22*d*. The intermediate transfer belt 28 moves in cycles, and during the cyclic movement, four toner images that are sequentially transferred from the photoreceptor drums 22*a*, 22*b*, 22*c*, and 22*d* provided on the four imaging units 71*a*, 71*b*, 71*c*, and 71*d* are superimposed. As a result, a full color toner image is formed from the four superimposed images. The full color toner image is collectively transferred to a recording paper at the secondary transfer unit 50 via the secondary transfer roller 39.

A toner image after being transferred to a recording paper is either fixed at the fixing unit T, or conveyed again to the secondary transfer unit 50. When the toner image is fixed at the fixing unit T, the toner image is ejected by a paper ejecting unit 80 to a tray-shaped ejection storage unit 5 through an ejection conveying path 81, and the image is recorded only on one side of the recording paper. When the toner image is conveyed again to the secondary transfer unit 50, the image is recorded on the both sides of the recording paper.

In the latter case where image is recorded on the both sides, a recording paper is conveyed to a recirculation conveying path 82, which is described below, and when the recording paper reaches the secondary transfer unit 50, the recording paper is turned over. A configuration of a conveying device used in a reversal conveying path is described below.

The conveying device includes the paper feeding unit 4 that includes an accommodating unit that can accommodate and hold recording papers and a dispensing unit, located directly under the imaging units 71*a*, 71*b*, 71*c*, and 71*d* used for the image forming unit 100, for dispensing recording papers from the accommodating unit.

The paper feeding unit 4 includes, as the accommodating unit that accommodates unused recording papers, a cassette 40 having an accommodating plate that is configured to be pushed upward by a biasing unit (not shown), a paper-feeding roller 41 as the dispensing unit that dispenses the recording papers accommodated in the cassette 40, a friction pad 42 as a separating unit that separates a sheet from the recording papers, a presence detecting unit 43 that detects whether a recording paper is present on the cassette 40, a registration sensor 60 that sets registration timing of a recording paper dispensed from the cassette 40 or of a recording paper introduced from a reversal path 44, which will be described below, a registration roller 61 that feeds a recording paper to the secondary transfer unit 50 according to the registration timing, the recirculation conveying path 82 used when a double side image is formed, and a path switching unit (not shown) used when a double side image is formed.

In the embodiment, the paper-feeding roller 41, the registration sensor 60, and the registration roller 61 are provided on the housing body 1A, and the other elements, or the cassette 40, the friction pad 42, and the reversal path 44, are configured so that all the elements can be inserted and detached from the housing body 1A. As a result, the elements can be inserted and detached from the housing body 1A without interfering with the housing body 1A. The cassette 40 may also be configured so that the cassette 40 constitutes a tray that can accommodate a large size recording paper (shown with the two-dot chain line in FIG. 1).

The recirculation conveying path 82 is configured so that the recirculation conveying path 82 branches off at a part of the ejection conveying path 81, bypasses the side of the image forming unit 100 in a horizontal direction, and an end of the recirculation conveying path 82 is connected continuously to the reversal path 44 that is integrally formed with the cassette 40 used for the paper feeding unit 4.

The reversal path 44 that is continued from the recirculation conveying path 82 and that constitutes a part of the recirculation conveying path 82 is configured so that an end of the reversal path 44 on the opposite side of the moving direction of the recording paper introduced into the recirculation conveying path 82 joins together at a point that is upstream of the registration roller 61 and at which a recording paper sheet is dispensed from the cassette 40. Thus, a recording paper introduced into the recirculation conveying path 82 is conveyed to the registration roller 61 in a similar way as a recording paper dispensed from the cassette 40, that is, a recording paper is transferred to the same position as a recording paper dispensed from the cassette 40.

The reversal path 44 is integrally formed with the cassette 40, for example, by molding. Conveying surfaces that oppose the front and the back sides of a recording paper are formed of an exterior cover 92 provided integrally with the cassette 40 and a conveying guide member 47 that is disposed opposing the exterior cover 92.

On the exterior cover 92 that constitutes one of the conveying surfaces of the reversal path 44, a handle 93 as an operating portion for inserting and detaching the cassette 40 of the paper feeding unit 4 into and from the housing body 1A, is provided.

One of the conveying surfaces of the reversal path 44 is configured so that the surface can be exposed to the outside, and thus the surface can be operated from the outside. In other words, one of the conveying surfaces corresponds to the exterior cover 92, and when the conveying guide member 47 that corresponds to the other surface opposing the exterior cover 92 is opened and closed in relation to the exterior cover 92 that corresponds to the other surface, the conveying surface corresponding to the exterior cover 92 can be exposed to the outside.

In a configuration of the conveying paths in which one of the conveying surfaces is exposed to the outside, the other surface can be opened. More specifically, the conveying guide member 47 is configured so that the conveying guide member 47 can be pivoted, that is, can be detached and attached in relation to the exterior cover 92.

In a configuration of the conveying guide member 47, the conveying guide member 47 is pivoted around a spindle 48, as the pivoting center, that is disposed on the opposite side of the conveying direction (indicated by an arrow F in FIG. 1) of a recording paper introduced into the reversal path 44 continued from the recirculation conveying path 82 so that the conveying guide member 47 is detached or attached in relation to one of the conveying surfaces, or the one corresponding to the exterior cover 92. In the configuration, when the cassette 40 is inserted into the housing body 1A, a base end side of the conveying guide member 47, or the side on which the spindle 48 is located, not a swing end side, is touched first by an inserted portion of the cassette 40. Thus, when the cassette 40 is inserted to the housing body 1A, the conveying guide member 47 pivots so that the conveying guide member 47 moves in the direction in which the conveying guide member 47 comes closer to the exterior cover 92. Thus, the reversal path 44 through which the recording paper passes is constituted. As a result, it is not required that the cassette 40 is manipulated so that the cassette 40 is in a closed state. Just by inserting the cassette 40, the reversal path 44 can be reconstituted. A closed position of the conveying guide member 47, that is, a distance between the conveying guide member 47 and the exterior cover 92, is determined when the swing end of the conveying guide member 47 is locked in a locking member (not shown) provided on the side of the cassette 40 closer to the housing.

In the configuration in which the conveying guide member 47 is detached, the conveying guide member 47 is configured as a closure that can be inserted and detached in relation to the exterior cover 92. In the configuration, the conveying guide member 47 functions as a closure that is disposed between the conveying guide member 47 and the exterior cover 92 with a certain distance between the conveying guide member 47 and the exterior cover 92. Therefore, just by detaching the conveying guide member 47, one of the conveying surfaces can be exposed. To make sure that the conveying guide member 47 functioning as a closure is not left detached, a detecting sensor (not shown) that detects if the conveying guide member 47 is inserted or not, for example, a push switch, may be provided on the locking member that defines the distance between the conveying guide member 47 and the exterior cover 92. It may be determined if the conveying guide member 47 that corresponds to the other side of the conveying surfaces is inserted securely or not, by using the detecting sensor.

Figure 2:
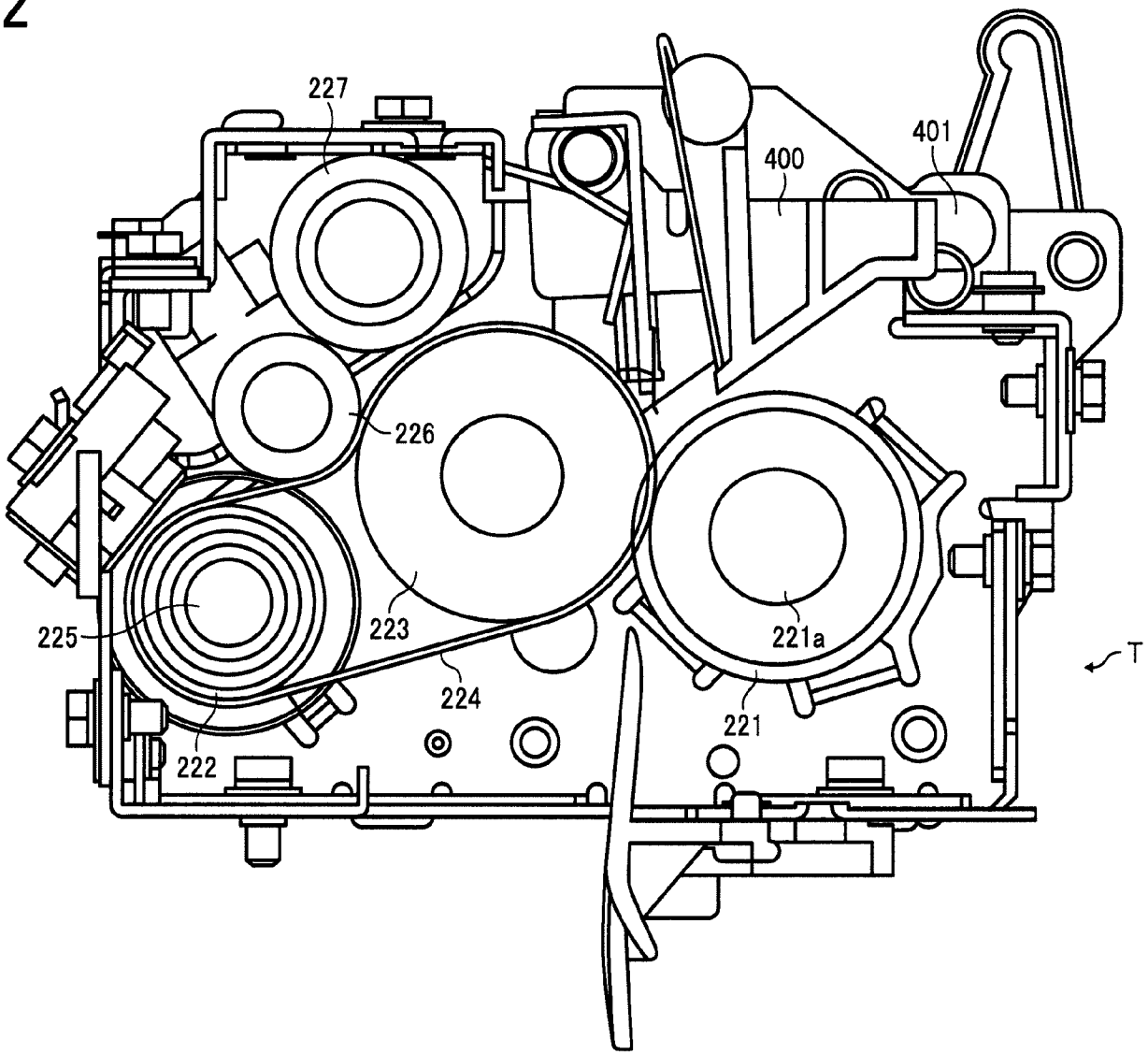
FIG. 2 is a schematic of internal structure of the fixing device shown in FIG. 1.

FIG. 2 is a schematic of a configuration of the fixing device T. The fixing device T includes a pair of fixing members opposing each other. More specifically, the fixing device T includes a pressure roller 221 that constitutes a side of the fixing members and a fixing belt 224 that is a belt member that is wound around between rollers 222 and 223 and that constitutes the other side, while the pressure roller 221 and the fixing belt 224 are opposing each other.

The roller 222 includes a heat source 225 that is located inside the roller 222 and that is connected to a power supply (not shown). Thus, the roller 222 functions as a heating roller.

The roller 223 constitutes a driving roller rotated by a driving motor (not shown) and also functions as a fixing roller. The rollers 222 and 223 are supported by a side plate (not shown) so as to rotate freely. The rollers 222 and 223 and the fixing belt 224 rotate counterclockwise in FIG. 2. As a result, the pressure roller 221 is rotated clockwise while contacting the fixing belt 224.

The pressure roller 221 is formed by providing an elastic layer such as silicon gum on a metal core, for example, made of aluminum or iron. The surface of the pressure roller 221 is a release layer made of perfluoroalkoxy (PFA) or polytetrafluoroethylene (PTFE).

Figure 3:
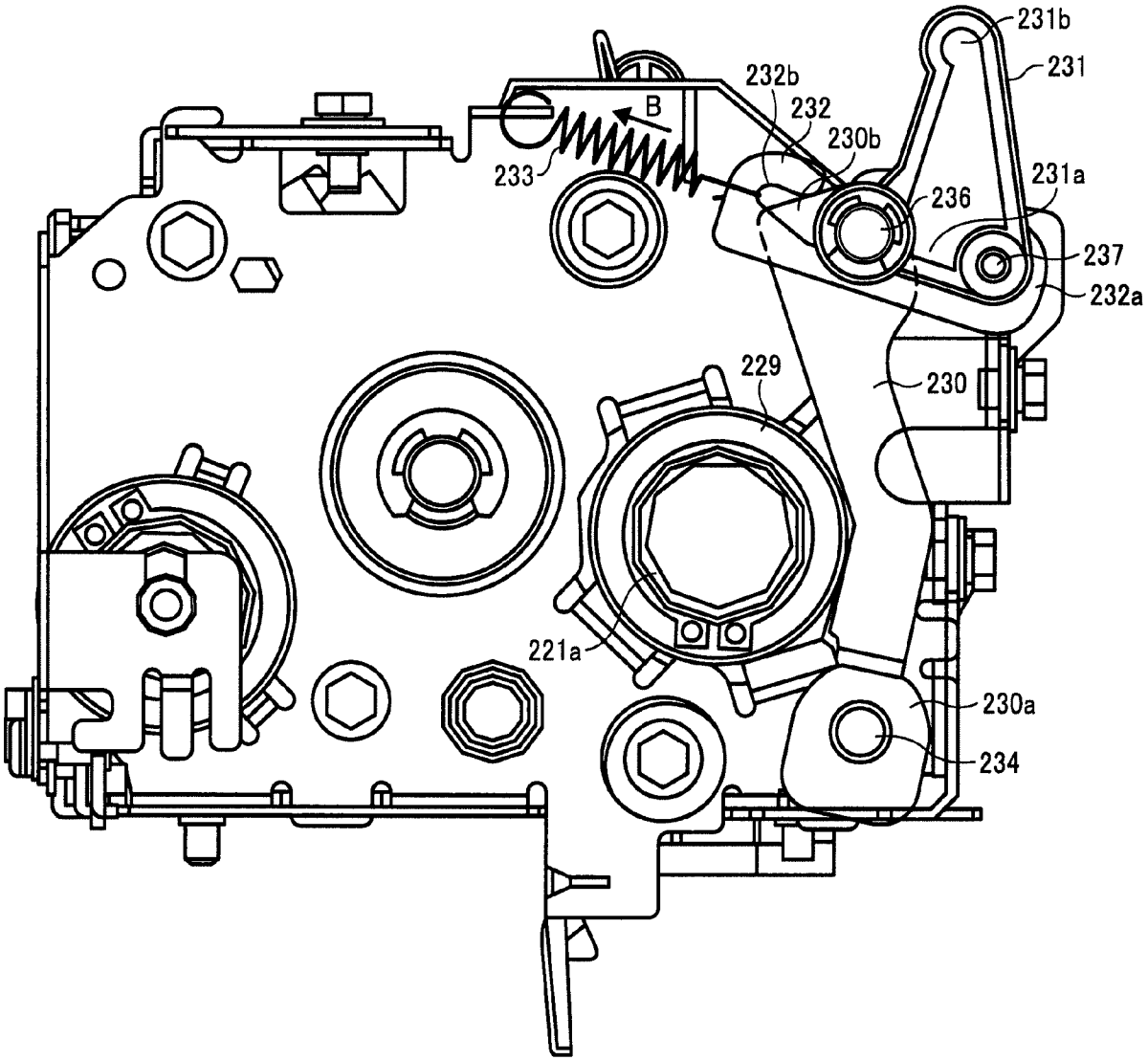
FIG. 3 is a schematic of main parts of a contacting and separating mechanism of a pressure roller in the fixing device shown in FIG. 2.

In FIG. 3, an end 221*a* of the metal core of the pressure roller is supported by a bearing 229 so as to pivot freely. The bearing 229 is supported by a side plate (not shown) so that the pressure roller 221 can be moved in the direction to contact or to be separated from the roller 223. Thus, the surface of the pressure roller 221 can be pressed against or separated from the fixing belt 224. A configuration for pressing and separating from the pressure roller 221 will be described in great detail below.

In the present embodiment, a halogen heater is used as the heat source 225 to heat the roller 222 and the fixing belt 224, which are heated members as well as heating circulating members. For example, as described in Japanese Patent Application Laid-open No. 2001-13805, which is applied by the applicant of the present invention prior to the present invention, the roller 222 and the fixing belt 224 can be heated by using induction heating method.

In general, electric power to the heat source 225 is supplied from commercial power supply (100V). However, an auxiliary power source may be provided to the commercial power supply, and power may be supplied from the auxiliary power source. For example, as disclosed in Japanese Patent Application Laid-open No. 2002-174988, which is applied by the applicant of the present invention prior to the present invention, an electric double layer condenser (electrochemical capacitor) is preferably used as an auxiliary power source. In the present embodiment, the roller 222 is used as a heating circulating member. An endless belt shaped member may, however, be used also as the heating circulating member. In FIG. 2, the numeral 226 denotes a belt tension roller and the numeral 227 denotes a belt cleaning roller.

Figure 4:
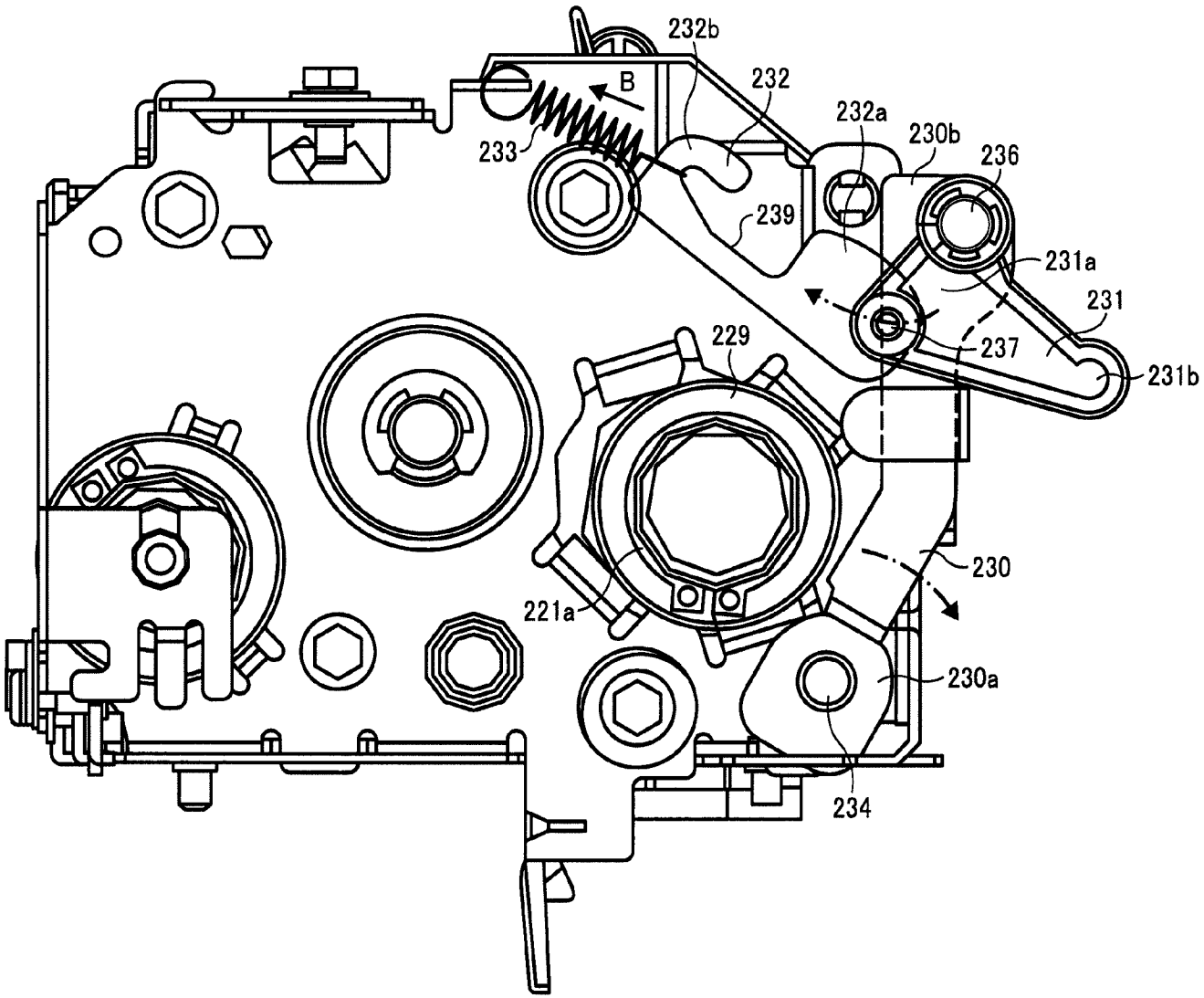
FIG. 4 is a schematic of an example of the contacting and separating mechanism shown in FIG. 3.

As shown in FIGS. 3 and 4, the fixing device T includes a pressing lever 230 that presses the pressure roller 221 against the fixing belt 224, a pressure releasing lever 231 rotatably supported by the pressing lever 230, a locking member 232 of which an end 232*a* is supported by the pressure releasing lever 231 so that the locking member 232 can rotate and that includes a concave portion 239 shown in FIG. 4, and an extension coil spring 233, or an elastic member that is locked to another end 232*b* of the locking member 232 and that pulls the locking member 232 in the direction indicated by an arrow B.

In the configuration above, as will be described in detail below, the position of the locking member 232 can be set either to a pressing position in which the pressure roller 221 is pressed against the fixing belt 224 by the pressing lever 230 or to a pressure releasing position in which the pressure roller 221 is separated from the fixing belt 224, by rotating the pressure releasing lever 231.

A lower end 230*a* of the pressing lever 230 is supported by a rotating shaft 234 that is inserted into a side plate (not shown) and supported by the side plate, and thus the pressing lever 230 can rotate. A base end side 231*a* of the pressure releasing lever 231 is supported on another end 230*b* of the pressing lever 230 in FIG. 3 by a shaft 236 provided on the pressing lever 230 so that the pressure releasing lever 231 can rotate.

In FIG. 3, the end 232*a* of the locking member 232 is supported so that a shaft 237 provided on the base end side 231*a* of the pressure releasing lever 231 can rotate. When the locking member 232 moves to a locking position shown in FIG. 3 and a releasing position shown in FIG. 4, the locking member 232 rotates about the shaft 236 as a hinge of the pressure releasing lever 231, and the shaft 237 is positioned so that the shaft 236 and the shaft 237 are on the same extension line of the axis line of the extension coil spring 233. When the locking member 232 moves to a releasing position shown in FIG. 4, the locking member 232 rotates about the shaft 236 as a hinge of the pressure releasing lever 231, and the shaft 237 is positioned so that the shaft 237 is out of the line connecting the extension coil spring 233 and the shaft 236. The shaft 237 can move either to a position in which the extending direction of the extension coil spring and the shafts 236 and 237 are on the same line, that is, a dead point, or to a position in which the shaft 237 is out of the dead point. When the pressure releasing lever 231 is positioned in the locking position shown in FIG. 3, the shaft 237 is positioned so that the shaft 237 opposes the other end 232*b* of the locking member with the shaft 236 as a center. When the pressure releasing lever 231 is positioned in the releasing position shown in FIG. 4, the shaft 237 is positioned so that the shaft 237 is on the same side of the other end 232*b* of the locking member 232 in relation to the shaft 236 as a center.

Between the end 232*a* and the other end 232*b* of the locking member, as shown in FIG. 4, the concave portion 239 is formed so that the shaft 236 on the side of the pressure releasing lever 231 can fit in the concave portion 239. When the pressure releasing lever 231 is positioned in the pressing position shown in FIG. 3, the shaft 236 fits in the concave portion 239 and thus the locking member 232 and the pressing lever 230 are locked in the locking position. When the pressure releasing lever 231 is in the releasing position shown in FIG. 4, the shaft 236 comes out of the concave portion 239, and thus the locking member 232 and the pressing lever 230 are released from the locking position.

In the embodiment, when the pressure releasing lever 231 rotates counterclockwise about the shaft 236, the pressure releasing lever 231 moves toward the locking member 232 so that the pressure releasing lever 231 approaches the locking member 232 from above. Thus, the concave portion 239 is configured so that an opening section of the concave portion 239 faces upwards. When the shaft 236 fits in the concave portion 239, the concave portion 239 is formed in such a way that the shaft 236 is positioned approximately over the pressing lever 230.

In the configuration above, when a condition of the pressure roller 221 is shifted from a pressing condition of the pressure roller 221 shown in FIG. 3 to a pressure releasing condition of the pressure roller 221 shown in FIG. 4, an end 231*b* of the pressure releasing lever 231 rotates clockwise about the shaft 236.

When the pressure releasing lever 231 rotates clockwise, because the shaft 236 pulled by pulling force of the extension coil spring 233 serves as the pivoting center of the pressure releasing lever 231, the locking member 232 sharing the shaft 237 rotates downwards along with the shaft 237 of the pressure releasing lever 231 from a position shown in FIG. 3 to a position shown in FIG. 4 and stops. Therefore, as shown in FIG. 4, the concave portion 239 of the locking member 232 also moves downwards, and the shaft 236 that fits in the concave portion 239 can be released from the concave portion 239. Thus, locking relationship when the shaft 236 fits in the concave portion 239 is lost, the shaft 237 is pulled by the extension coil spring 233 and the shaft 237 moves to the left side of the shaft 236 in FIGS. 3 and 4 and approaches toward the extension coil spring 233, that is, the same side of the other end 232*b* of the locking member 232. The extension coil spring 233 returns to its natural length.

When the locking member 232 is pulled by the extension coil spring 233 and the pressure releasing lever 231 rotates as shown in FIG. 4, if the shaft 237 is pulled, the side on which the shaft 236 of the pressure releasing lever 231 is located in the condition shown in FIG. 4 is pushed in the opposite direction relative to the pulling direction. Then, the pressing lever 230 is rotated clockwise in FIG. 4 about the rotating shaft 234, because a force couple acts on the shaft 236. This is possible when the pressure releasing lever 231 is in a condition in which the pressure releasing lever 231 stops rotating on its own when the shaft 237 is pulled. Thus, the locking member 232 is pulled by the extension coil spring 233. As a result, the pressing lever 230 is moved in such a way that the pressing lever 230 is separated from the pressure roller 221, and the pressure of the pressure roller 221 from the pressing lever 230 is released.

On the contrary, when the pressure releasing lever 231 is moved from an open position shown in FIG. 4 to a closed position shown in FIG. 3, the pressure releasing lever 231 and the pressing lever 230 are moved to a pressing direction (in the left direction in FIGS. 3 and 4), and the pressure roller 221 is pressed against the fixing belt 224. When the pressure roller 221 and the fixing belt 224 contact with each other, movement of the pressing lever 230 is restricted, and the pressure releasing lever 231 rotates about the shaft 236 counterclockwise. Along with the rotation of the pressure releasing lever 231, the locking member 232 rotatably supported by the pressure releasing lever 231 moves toward right in FIGS. 3 and 4 against the spring force of the extension coil spring 233 about the shaft 236.

When the pressure releasing lever 231 further moves toward the closed position, the shaft 236 fits in the concave portion 239, so that rotation of the pressure releasing lever 231 is controlled. Furthermore, spring force of the extension coil spring 233 works on the locking member 232, so that the locking member 232 is biased toward the locking direction B. Thus, a pressed state of the pressure roller 221 and the fixing belt 224 is maintained. Then, the pressing lever 230 fits in the locking member 232 in a most distant position on the pressing lever 230 from the rotating shaft 234. By the spring force of the extension coil spring 233, the pressing lever 230 and the locking member 232 are pulled in the locking direction B. Then, the locking member 232 is positioned at the most distant position from the rotating shaft 234, and because of the principle of the lever, the force presently received is smaller compared with force received when the locking member 232 is positioned closer to the rotating shaft 234 of the pressing lever 230. Thus, force received when the shaft 236 moves on the locking member 232 is also small.

Figure 9:
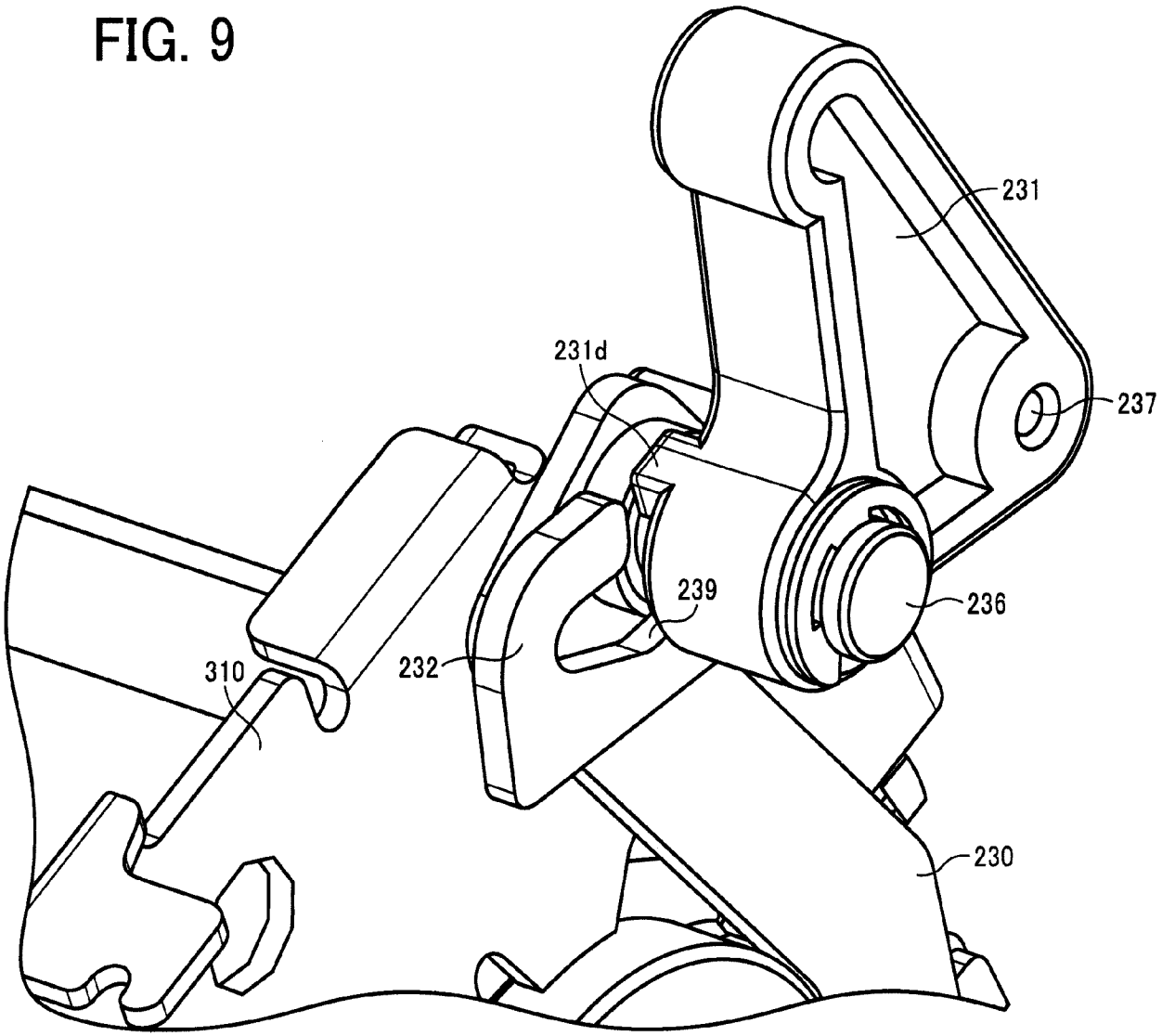
FIG. 9 is a perspective view for explaining a configuration of a supporting unit of a pressure releasing lever in the contacting and separating mechanism shown in FIG. 3.
Figure 10:
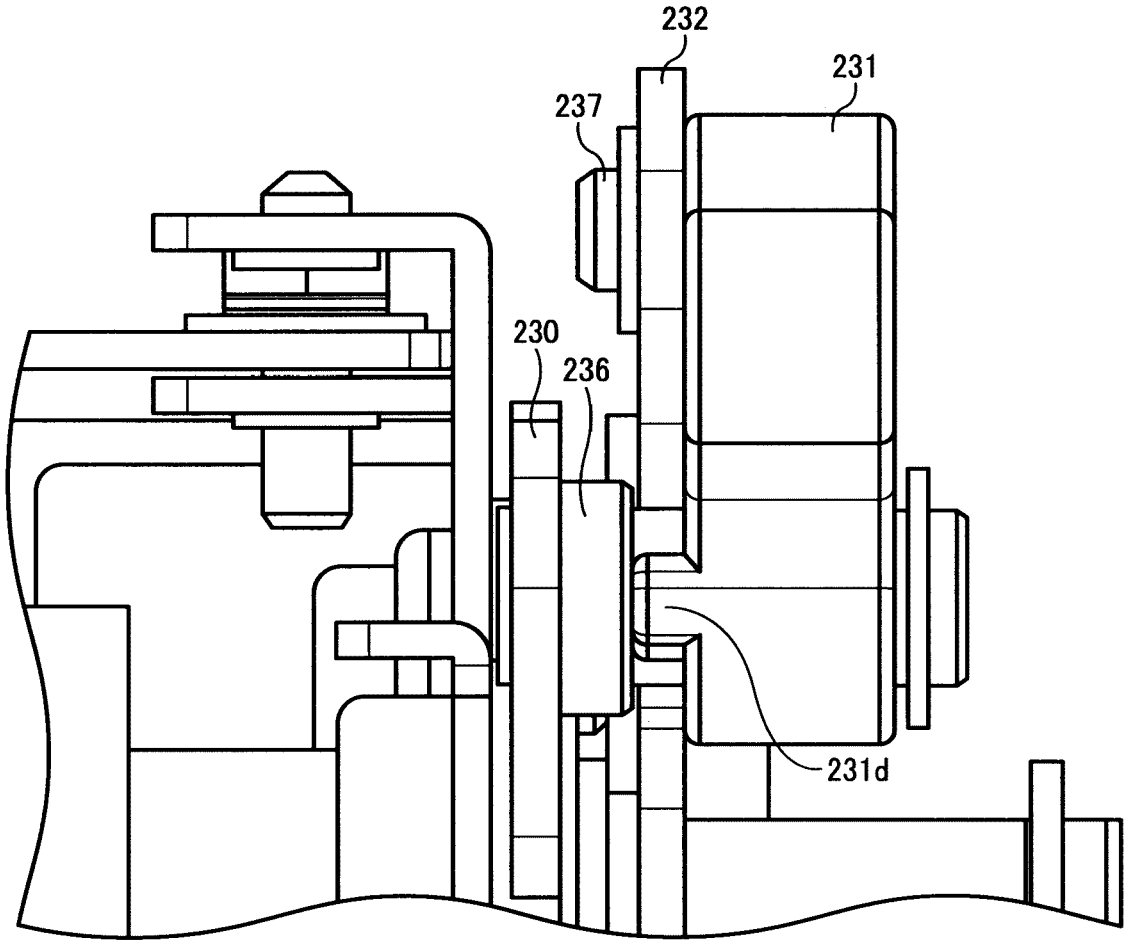
FIG. 10 is a plan view of the supporting unit shown in FIG. 9.

FIG. 9 is a perspective view of the pressure releasing lever 231 in the closed position. Space bigger than the thickness of the locking member 232 needs to be provided in the pressure releasing lever 231 in the longitudinal direction of the shaft 236 so that the locking member 232 and the shaft 236 can be securely engaged with each other. Therefore, a contacting portion 231*d* is provided in the pressure releasing lever 231, and the contacting portion 231*d* touches a root portion of the shaft 236. FIG. 10 is a schematic showing a top view of the pressure releasing lever 231 in the closed position. The width of the contacting portion 231*d* is larger than the thickness of the locking member 232. Thus, the locking member 232 and the shaft 236 can be securely engaged with each other.

Figure 5:
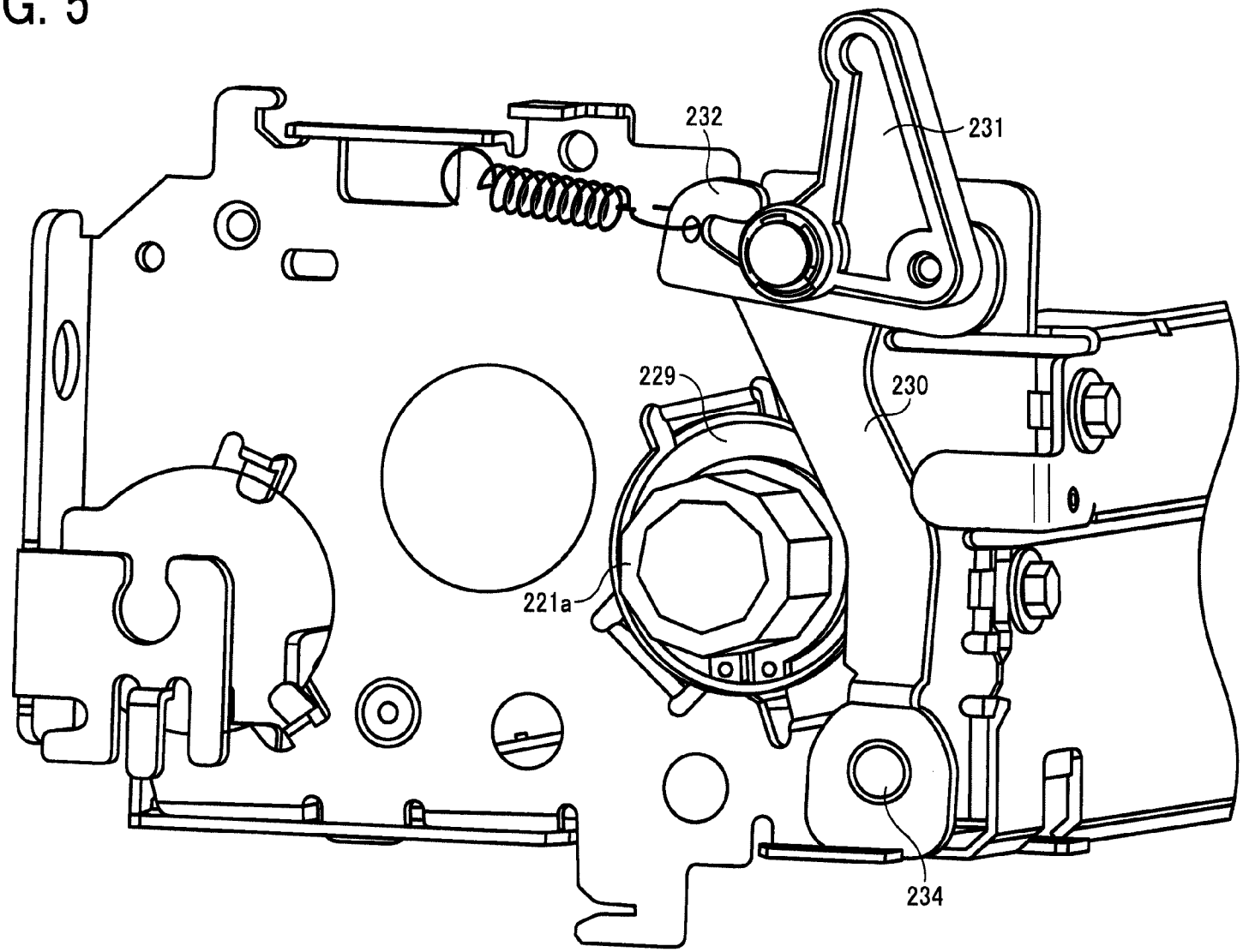
FIG. 5 is a perspective view of an appearance of the contacting and separating mechanism shown in FIG. 3.

As described above, the pressing lever 230 requires strong force. Thus, as shown in FIG. 5, the pressing lever 230 may be tilted because of spring force of the extension coil spring 233 or may be deformed. The pressing lever 230 also presses the bearing 229 that supports the end 221*a* of the metal core. When a portion pressed by the pressing lever 230 is disturbed in the direction of the shaft and pressure is applied on the end 221*a* of the metal core of the pressure roller, desired pressing force is not obtained, causing the problems described above.

Figure 6:
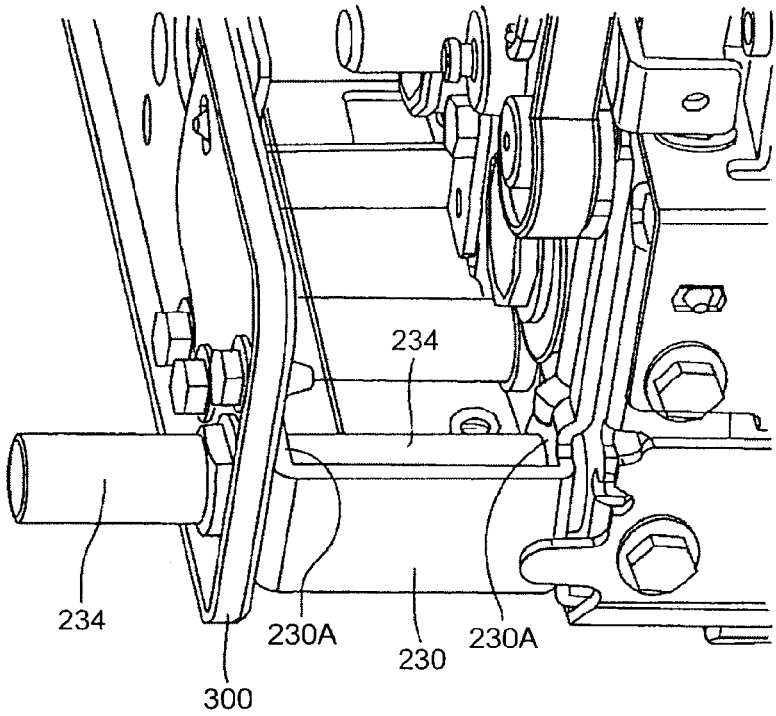
FIG. 6 is a schematic of a conventional configuration of a shaft supporting unit used in the contacting and separating mechanism shown in FIG. 3.

FIG. 6 depicts a conventional example for solving the above problems.

In a configuration shown in FIG. 6, the rotating shaft 234 of the pressing lever 230 is prolonged by extending the rotating shaft 234. In pieces 230A located on both ends of the region in which the rotating shaft 234 is extended, two holes are coaxially provided on the rotating shaft 234 so that the rotating shaft 234 is inserted. Thus, the pressing lever 230 is prevented from tilting. For preventing the pressing lever 230 from falling off, a displacement stopping plate 300 is disposed outside of the pressing lever 230. As a result, the pressing lever 230 is prevented from tilting due to spring force of the extension coil spring 233. However, the above configuration of components is complicated and it is difficult to achieve Weight saving or space saving.

Figure 7:
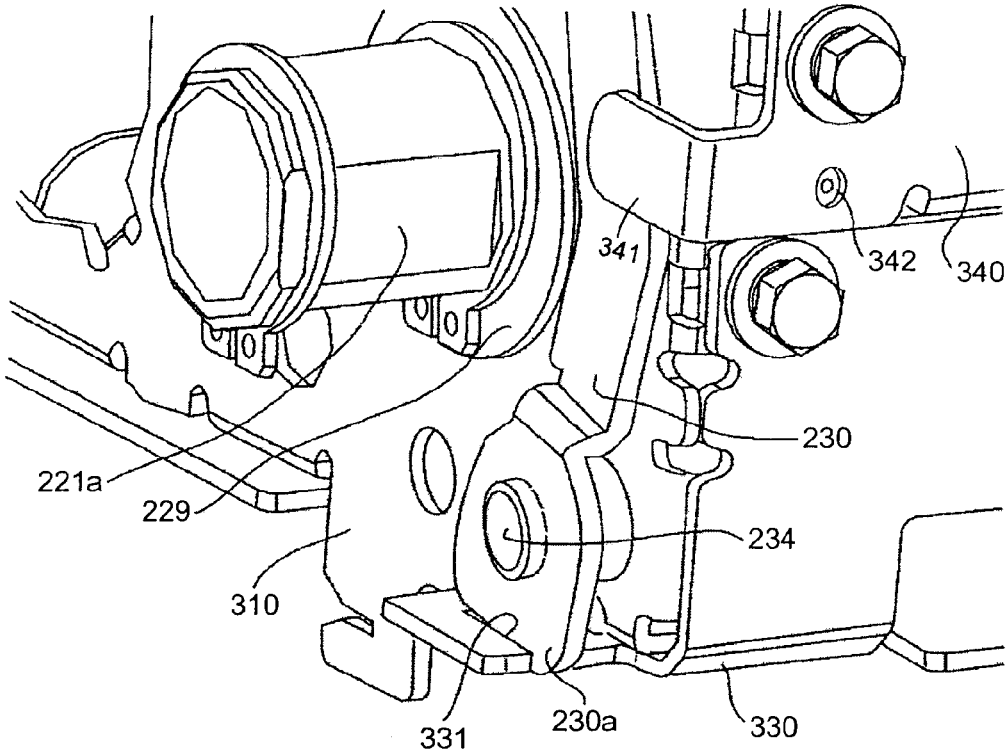
FIG. 7 is a schematic for explaining a supporting structure in the contacting and separating mechanism shown in FIG. 3.

FIG. 7 is, on the contrary, a schematic of a configuration according to the present embodiment. In FIG. 7, a left frame 310 and a right frame (not shown) are fixed to the left and the right sides of a lower frame 330. That is, the lower frame 330 is fixed to the left frame 310 and the right frame (not shown) on an upstream side of a paper moving direction. Each of the left frame 310 and the right frame is made of metal, and constitutes a structure of the fixing device T. The left frame 310 includes the rotating shaft 234 that is inserted into a hole of the pressing lever 230. The lower frame 330 includes a first control unit 331 that is in a shape of a slit and controls movement of the end 230*a* of the pressing lever 230 in the direction of the rotating shaft 234, for preventing the pressing lever 230 from tilting or from displacement in the direction of the rotating shaft 234. The left frame 310 and the right frame (not shown) are positioned directly on the lower frame 330, and dimensional accuracy of the first control unit 331 and the end 230*a* of the pressing lever 230 is high.

Above front portions of the left frame 310 and the right frame (for convenience, the right frame is not shown, a front frame 340 made of metal is fixed on the side near a rear part of the pressure roller, and the front frame 340 forms a structure of the fixing device T. A second control unit 341 is provided on the front frame 340 for controlling movement of a central portion of the pressing lever 230 in the direction of the rotating shaft 234, to prevent the pressing lever 230 from tilting and displacement in the direction of the rotating shaft 234.

Figure 8:
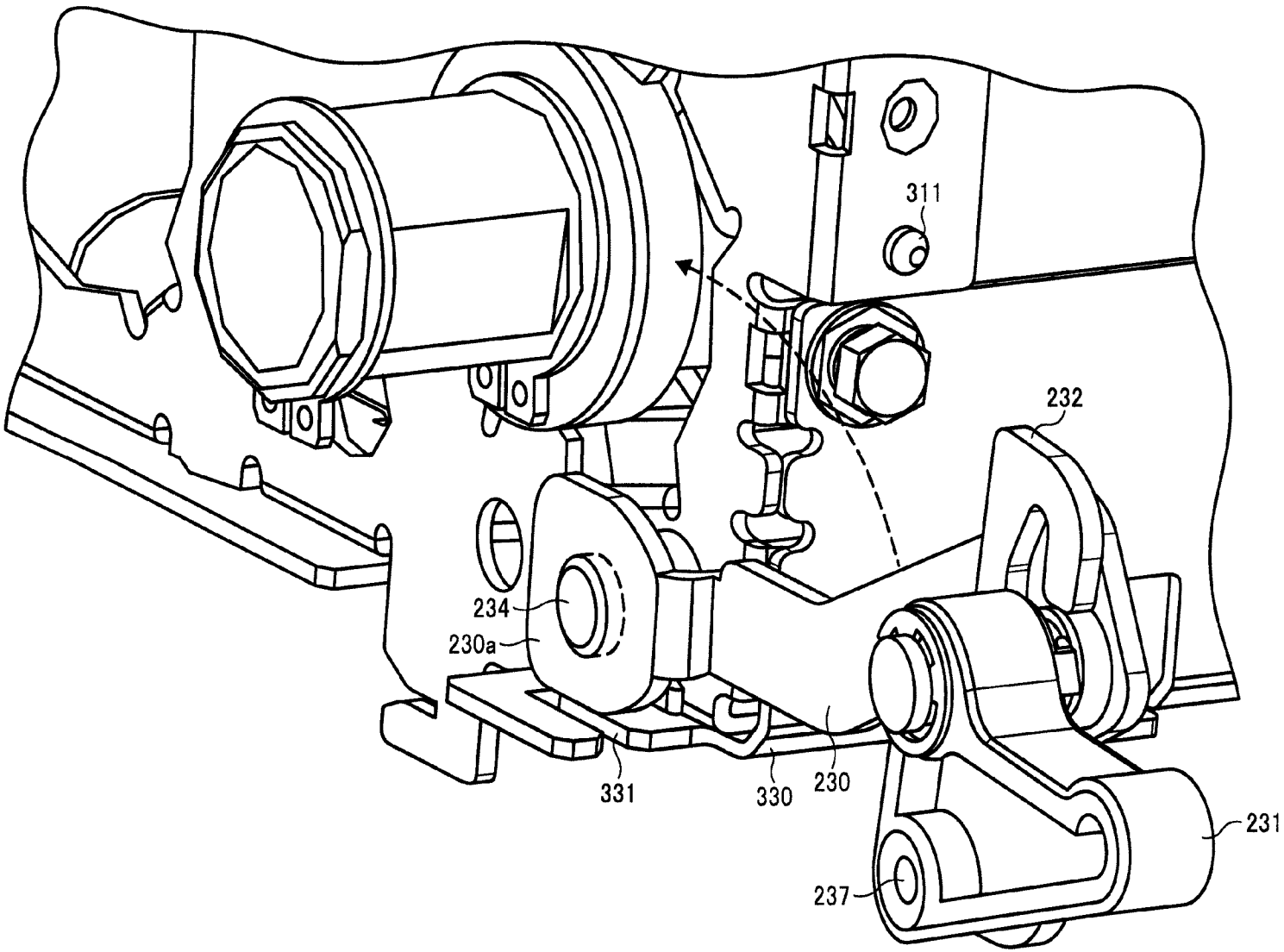
FIG. 8 is a schematic of an assembling condition of the supporting structure shown in FIG. 7.

As shown in FIG. 8, a protrusion 311 of the left frame 310 is positioned directly in a circular hole 342 of the front frame 340 shown in FIG. 7. The protrusion secures the minimal length so that the pressing lever 230 can move in the rotation direction in the space between the left frame 310 and the second control unit 341 of the front frame 340.

A protrusion (not shown) of the right frame (not shown), or a frame on the other side in general is positioned directly in a long hole (not shown) of the front frame 340. In the long hole (not shown), space between the right frame (not shown) and the second control unit of the front frame 340 is fluctuated. Therefore, the protrusion (not shown) of the right frame (not shown) is also positioned directly in a circular hole (not shown). Thus, the protrusion secures the minimal length so that the pressing lever 230 can move in the pivoting direction in a space between the right frame and the second control unit of the front frame 340.

FIG. 8 is a schematic of the pressing lever 230 when the pressing lever 230 is attached. Before the front frame 340 is attached, however, the pressing lever 230 is inserted into the rotating shaft 234 while the pressing lever 230 is in a horizontal position. The end 230*a* of the pressing lever 230 is not engaged with the first control unit 331, in a shape of a slit, of the lower frame 330. The pressing lever 230 is rotated about the rotating shaft 234, and when the pressing lever 230 is in a state shown in FIG. 7, the end 230*a* of the pressing lever 230 is controlled due to engagement with the first control unit 331. In this state, the front frame 340 is attached, and the minimal space between the left and the right frames and the second control unit 341 is secured so that the pressing lever 230 can move in the pivoting direction.

Figure 11:
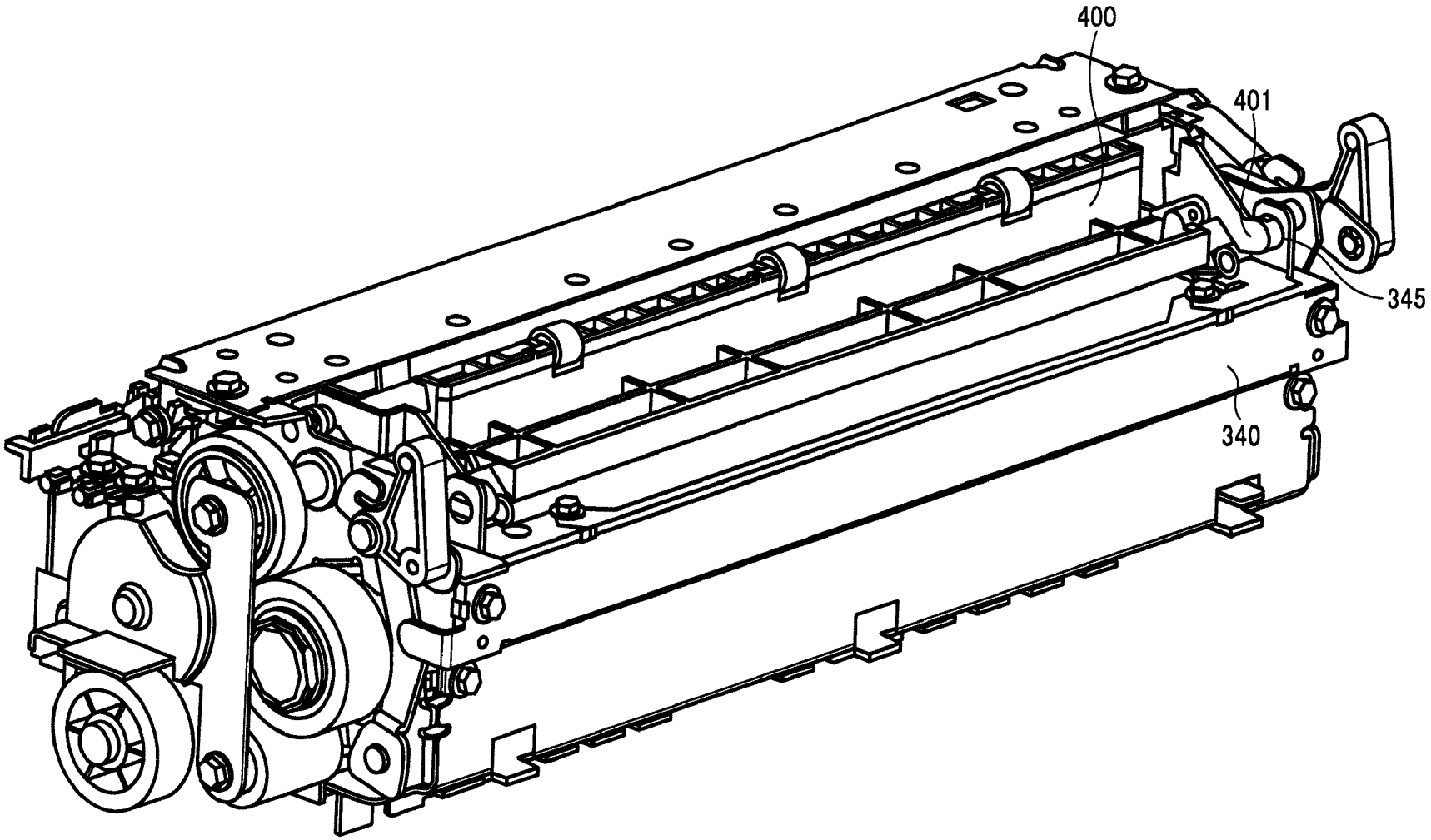
FIG. 11 is a perspective view of a configuration of a conveying guide unit in the fixing device shown in FIG. 2.

Referring back to FIG. 2, an exit guide 400 that forms a conveying path of a sheet is disposed in a downstream side of a paper moving direction between the roller 223 and the pressure roller 221 opposing each other. On the contrary, in the example shown in FIG. 11, the exit guide 400 includes a rotating shaft unit 401 formed on each of the left and the right sides of the exit guide 400. Removing of jammed paper can be performed by opening the exit guide 400 with rotation about the rotating shaft unit 401. The rotating shaft unit 401 of the exit guide 400 is rotatably supported by shaft holes 345 that are integrally provided with the front frame 340. The exit guide 400 requires conveying accuracy of a sheet after fixing. The left frame 310 and the right frame can be deformed easily because of strong force from the extension coil spring 233 on the left frame 310 and the right frame. When the rotating shaft unit 401 of the exit guide 400 is rotatably supported by the left frame 310 and the right frame, it is difficult to secure the conveying accuracy after fixing.

In the present embodiment, the front frame 340 is positioned securely in the front side of the left frame 310 and the right frame. Thus, the conveying accuracy after the fixing can be secured.

According to an aspect of the present invention, a structure of a fixing device can be simple, and low cost, weight saving, and space saving are achieved. The pressing lever is prevented from tilting, balance between pressures applied on the left and the right ends is prevented from being lost and kept equally. Desired action of self-stripping is secured, and poor fixing of a toner image can be prevented.

According to another aspect of the present invention, the pressing lever is configured so that the pressing lever is positioned in a pressing position or in a pressure releasing position according to how the locking member is rotated relative to the dead point as a branch point by using an elastic material. A contacting and separating mechanism between fixing members of a fixing device forms a rotatable locking member and an elastic material that pulls the locking member. As a result, a locking member can be securely locked in a locking condition.

According to still another aspect of the present invention, an exit guide is positioned on a front frame, not on the left and the right frames that may be deformed easily due to strong forces from the extension coil spring 233. As a result, poor accuracy of positioning of an exit guide due to the deformation of the frames can be prevented, and accuracy of conveying of recording paper after a toner image is fixed on the recording paper can be enhanced.

According to still another aspect of the present invention, an image forming apparatus can be provided in which a pressing lever is prevented from tilting, balance between pressures applied on the left and the right ends can be prevented from being lost and kept equally, desired action of self-stopping is secured, and poor fixing of toner image is prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing member including a first member and a second member that sandwich a recording medium and apply heat and pressure to fix a toner image on the recording medium;

a pressing lever having a first end that is adjacent to a rotating shaft, the pressing lever being rotatable around the rotating shaft and moves either to a pressing position in which the first member is pressed toward the second member or to a releasing position in which the first member is separated from the second member; and a first control unit that is arranged near the first end of the pressing lever and controls displacement of the first end of the pressing lever in an axial direction of the rotating shaft when the pressing lever moves between the pressing position and the releasing position.

2. The fixing device according to claim 1, wherein the first control unit is arranged on a member of a structure of the fixing device.

3. The fixing device according to claim 1, further comprising:

a pair of frames that support axes of the first member and the second member; and a lower frame that is fixed to the pair of frames on an upstream side of a moving direction of the recording medium, wherein the first control unit is arranged on the lower frame.

4. The fixing device according to claim 3, wherein the lower frame is positioned in an axial direction of the first member and the second member.

5. The fixing device according to claim 1, wherein the first control unit is a metal frame.

6. The fixing device according to claim 1, further comprising a second control unit that controls displacement of a second end of the pressing lever, the second end of the pressing lever being opposite to the first end of the pressing lever, in the axial direction when the pressing lever moves between the pressing position and the releasing position.

7. The fixing device according to claim 6, wherein the second control unit is a metal frame.

8. The fixing device according to claim 1, further comprising:

a pair of frames that support axes of the first member and the second member; and a front frame that is fixed to the pair of frames on a side of a pressure member of the fixing member with respect to a moving direction of the recording medium, wherein a second control unit is arranged on the front frame.

9. The fixing device according to claim 8, wherein the front frame is positioned in an axial direction of the first member and the second member.

10. The fixing device according to claim 1, further comprising:

a releasing lever rotatably supported by the pressing lever;

a locking member rotatably attached to the releasing lever at a first end of the locking member; and an elastic member that is fixed to a second end of the locking member, the second end of the locking member being opposite to the first end of the locking member, and pulls the locking member in a locking direction, wherein the locking member moves along with rotation of the releasing lever whereby the pressing lever is caused to move either toward the pressing position or toward the releasing position, and wherein in the pressing position, the locking member fits into a second end of the pressing lever, the second end of the pressing lever being opposite to the first end of the pressing lever, and is pulled by the elastic member in the locking direction.

11. The fixing device according to claim 10, further comprising:

a first shaft that rotatably supports the releasing lever and the locking member; and a second shaft that rotatably supports the releasing lever and the pressing lever, wherein when the pressing lever moves from the releasing position to the pressing position, the first shaft rotates around the second shaft and passes an extension line connecting the second shaft and the second end of the locking member.

12. The fixing device according to claim 10, further comprising:

a first shaft that rotatably supports the releasing lever and the locking member; and a second shaft that rotatably supports the releasing lever and the pressing lever, wherein in the pressing position, the second shaft is fitted into the locking member, wherein in the releasing position, the second shaft is released out of the locking member, and wherein when the pressing lever moves from the releasing position to the pressing position, the second shaft moves over a concave portion provided on the locking member.

13. The fixing device according to claim 10, further comprising:

a first shaft that rotatably supports the releasing lever and the locking member; and a second shaft that rotatably supports the releasing lever and the pressing lever, wherein in the pressing position, the second shaft is fitted into the locking member, wherein in the releasing position, the second shaft is released out of the locking member, and wherein the releasing lever further includes a contacting portion that assures a predetermined space for fitting the second shaft into the locking member.

14. The fixing device according to claim 10, wherein the fixing member includes a heating roller, a fixing roller, and a pressure roller opposing the fixing roller, wherein a fixing belt is provided between the heating roller and the fixing roller, wherein a nip portion is formed between a contacting portion of the fixing belt and the fixing roller and the pressure roller, wherein a sheet with a toner image is conveyed from a transfer member to the nip portion to apply pressure and heat to the sheet, so that the toner image is fixed onto the sheet, and wherein the sheet is guided and discharged from an exit guide member disposed near the fixing member.

15. The fixing device according to claim 14, wherein the exit guide member is supported by the front frame.

16. The fixing device according to claim 1, wherein the first control unit is a frame including a slit into which the first end of the pressing lever passes.

17. An image forming apparatus comprising:

a fixing device including a fixing member including a first member and a second member that sandwich a recording medium and apply heat and pressure to fix a toner image on the recording medium;

a pressing lever having a first end that is adjacent to a rotating shaft, the pressing lever being rotatable around the rotating shaft and moves either to a pressing position in which the first member is pressed toward the second member or to a releasing position in which the first member is separated from the second member; and a first control unit that is arranged near the first end of the pressing lever and controls displacement of the first end of the pressing lever in an axial direction of the rotating shaft when the pressing lever moves between the pressing position and the releasing position.

* * * * *